United States Patent [19]

Eickmann

[11] Patent Number: 4,926,744

[45] Date of Patent: May 22, 1990

[54] RADIAL PISTON HYDRAULIC MACHINE WITH PISTON HAVING TWELVE CIRCUMFERENTIAL FLUID BEARING POCKETS

[76] Inventor: Karl Eickmann, 2420 Isshiki, Hayama-machi, Kanagawa-ken, Japan

[21] Appl. No.: 174,292

[22] Filed: Mar. 28, 1988

Related U.S. Application Data

[60] Continuation-in-part of Ser. No. 799,688, Nov. 19, 1985, abandoned, which is a continuation-in-part of Ser. No. 419,375, Sep. 17, 1982, abandoned, which is a division of Ser. No. 110,080, Jan. 7, 1980, Pat. No. 4,478,733, which is a division of Ser. No. 765,221, Feb. 3, 1977, Pat. No. 4,193,336, which is a continuation-in-part of Ser. No. 528,346, Nov. 29, 1974, Pat. No. 4,037,523.

[51] Int. Cl.[5] ..... F01B 9/06; F01B 13/06; F01M 1/06

[52] U.S. Cl. ..... 92/58; 92/72; 92/127; 92/158; 92/160; 91/488

[58] Field of Search ..... 92/52, 58, 72, 127, 92/159, 160, DIG. 2; 91/488

[56] References Cited

U.S. PATENT DOCUMENTS 3,255,706 6/1966 Eickmann ..... 91/488 X

FOREIGN PATENT DOCUMENTS 1403754 1/1969 Fed. Rep. of Germany ..... 91/488
3041367 5/1981 Fed. Rep. of Germany ..... 92/58

*Primary Examiner*—Robert E. Garrett
*Assistant Examiner*—George Kapsalas

[57] ABSTRACT

A member oscillates on a face and another member pivots on a bed of the first member. Passages are provided through the members to lead a lubrication fluid under pressure into a fluid pocket between the mentioned face and one of the members. The fluid pressure in the pocket carries a major portion of the load of one of the members on the face. The oscillation of the members has one stroke under higher load and one under less load. The pivotal movement of the other member controls the flow of fluid through the passages to provide high pressure in the fluid pocket at the stroke under higher load and lower pressure in the pocket at the stroke under less load. The arrangement is especially suitable to be provided on pistons and piston shoes of radial piston machines. But it can also serve to carry load on other members of machines or vehicles, wherein at least two movements are taking place and a source of supply of fluid under pressure is available. This present application claims the details of the arrangements of fluid pressure pockets on pistons of radial piston pumps and motors.

5 Claims, 5 Drawing Sheets

21
XIV
233
21
16
16
214
298
214
298
299
8
58
299
60
286
61
62
7
285
209
XV
202
288
63
14
61
XIV 291
293
286
287
233
293
230
8
282
283
62
280
281
202
7
231
63
288

281
7, 288
9
202
280

RADIAL PISTON HYDRAULIC MACHINE WITH PISTON HAVING TWELVE CIRCUMFERENTIAL FLUID BEARING POCKETS

REFERENCE TO RELATED APPLICATIONS

This is a continuation in part application of my application Ser. No. 799,688, filed on Nov. 19, 1985, now abandoned which was filed as a Continuation in part application of my earlier application Ser. No. 06-419,375, filed on Sept. 17, 1982, now abandoned, as a divisional application of my earlier patent application Ser. No. 110,080 which was filed on Jan. 7th, 1980.

The mentioned earlier application Ser. No. 110,080 is a divisional application of my earlier patent application Ser. No. 765,221 which was filed on Feb. 3rd, 1977, and which issued as U.S. Pat. No. 4,193,336 on Mar. 18th, 1980.

The mentioned earlier application Ser. No. 765,221 was a continuation in part application of the still earlier application Ser. No. 528,346 of Nov. 29th, 1974, which issued as U.S. Pat. No. 4,037,523 on Jul. 26th, 1977. application Ser. No. 110,080 issued as U.S. Pat. No. 4,478,733 on Oct. 23, 1984.

BACKGROUND OF THE INVENTION

In my elder U.S. Pat. No. 3,255,706 I have disclosed a fluid pressure pocket in a piston wall to reduce the friction between the cylinder and the wall.

In this patent however, the piston carried a part-cylindrical pivot-portion of a piston shoe, whereby the piston shoe prevented a rotation of the piston around the axis of the piston.

In another parental application, which is now U.S.-Pat. No. 4,037,523, I have also disclosed a part-spherical pivot-member on a piston shoe, borne on a complementary formed bed on the piston. Such part-spherical pivot-portions are also common in the former art.

The part-spherical pivot portions can not prevent a rotation of the piston relatively to the piston shoe.

The piston however exerts during pivotal movement of the piston shoe a lateral or tangential load onto the wall of the cylinder wherealong the piston slides. This load is in the direction of an imaginary plane constituted by the move of the imaginary axis of pivotion of the piston shoe.

Since the part-spherical pivot-portion of a piston shoe can not prevent a rotation of the piston relative to the piston shoe, the fluid pressure pocket in the piston, when applied, might move out of the direction of said load and thereby prevent the desired carrying of the load by the fluid pressure pocket. It might even transfer the force in the fluid pressure pocket by rotating the piston to another, undesired direction. It would then press the piston on the opposite side against the cylinder wall and thereby increase the friction between the oscillating or reciprocating piston and the wall of the cylinder so drastically, that the device with the pocket would be of less efficiency than a device without a fluid pressure pocket in the piston.

SUMMARY OF THE INVENTION

The aim of the invention is, to prevent such rotation of a piston relative to a piston shoe and thereby to prevent the increase of friction and to provide an assembly to prevent rotation of a piston relative to a shoe with part spherical pivot portion in order to make the provision of fluid pressure balancing pockets in such pistons possible, which carry such part-spherical pivot-portion.

At research of the mentioned aim of the invention, it has now been found, that the arrangement of the invention is not only applicable in hydraulic or pneumatic pumps or motors with pistons and piston shoes, but also in other machines or vehicles and generally in devices, where two members move relatively to each other and one of the members moves along a body, when a source for supply of pressure is available and when the body contains means to restrict the size of the respective movements to keep the arrangement in place and together.

The main objects of the invention are obtained by the following arrangements:

An arrangement to reduce friction in a device which includes at least two bodies, two members and two faces which slide along each other under a pivoting load;

wherein one of said bodies contains a space for the reception of at least a portion of one of said members;

wherein one of said members is provided with a bed to bear thereon a pivot portion of the other of said members;

wherein said members pivot relative to each other in alternating opposite directions when one of said members is borne in said bed of the other of said members;

wherein one of said members does a movement in said space whereby it slides with its outer face along a respective wall-face of said space, wherein said bodies include retaining portions located on opposite ends of said members to limit the extent of said movement, wherein at least one of said bodies forms retaining walls on two opposite site sides of one of said members;

wherein at least one pocket is provided in one of said members and open toward said wall-face of said space;

wherein one of said members is provided with a first passage means communicated to a chamber with fluid under pressure and a second passage means communicating with said pocket;

wherein a third passage means is provided in the other of said members for communication with said first passage means and alternating communication and discommunication with said second passage means during pivoting of said members;

wherein at least one of said members has an inner recess of a non-circular cross section;

wherein said recess is open toward the other of said members;

wherein an element of a cross section at least partially complementary to said cross-section of said recess is associated with said members, extending into both of said members and extending into said recess;

wherein said passages supply fluid into said pocket; serve to maintain fluid and pressure in said pocket and to carry at least a portion of the load of said member on said wall face;

wherein said pocket is located in the direction of the load of the respective member on said wall face;

wherein said movement is an oscillation with a stroke under load and another stroke under less load;

wherein said movement is provided in the concentration of the load of the respective member on said wall-face and in the direction of said load; and;

wherein said recess and said element serve to maintain a first equal direction of said members relatively to each other whereby they maintain said direction of said load and keep said movement in said concentration and direction of said load by preventing displacement of said pocket out of said concentration and direction of said load.

or; The arrangement of above, wherein said bodies are actuating said movement.

or; The arrangement of above, wherein one end of said element is fastened in one of said members and carries a holding means to keep the other of said members between said one of said members and said holding means.

or; The arrangement of above, wherein said other member includes a holding face to carry said holding means thereon and said holding face is of a suitable configuration to permit a smooth slide of said holding means along said holding face during said pivotion of said members.

The very specific object of the present invention is to make a revolvable piston in a radial piston pump or motor lateral balancing fluid pressure pockets in the specific direction of the lateral load which appears on the respective pistons.

More solutions, features, objects or aims of the invention may become apparent from the description of the preferred embodiments and the drawings. The term: "pivotion" defines a pivotal movement.

The commonly medial elements 1, 5, 7, 288 and 601 are shown in some of the mentioned Figures in views from the outside onto them within the otherwise sectional drawings of the respective FIGS. 1 to 16, 19, 20, 22 and 23 to elevate their importance, as is often custom in drawings of technical illustrations.

DETAILED DESCRIPTION OF THE PREFERRED EMBODIMENTS:

The mentioned enlarged figures contain partial clarifications compared to the applications, where they are taken from. The sectional Figures show in part some of the elements not in section but in a view onto them, as it appears in the respective sectional arrangement.

GENERAL DESCRIPTION OF THE PREFERRED EMBODIMENTS:

As far as reference numbers are appearing in parentheses in this description, the parentheses indicate, that the number is the number used in the application or patent, wherefrom the respective Figure is taken.

Figure 2:
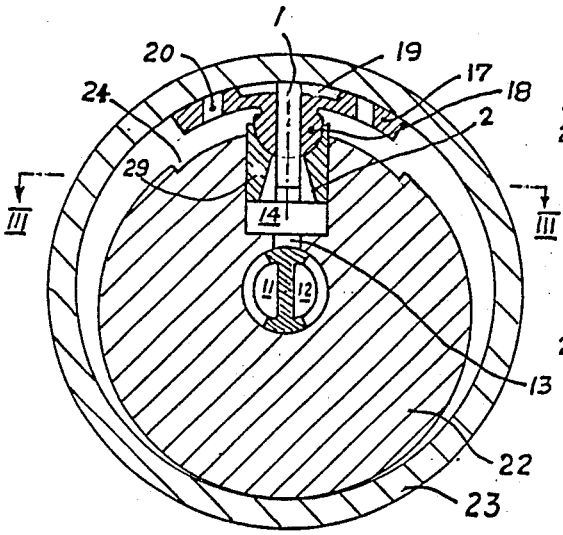
FIG. 2 is a cross-sectional view through FIG. 1 along II—II.
Figure 1:
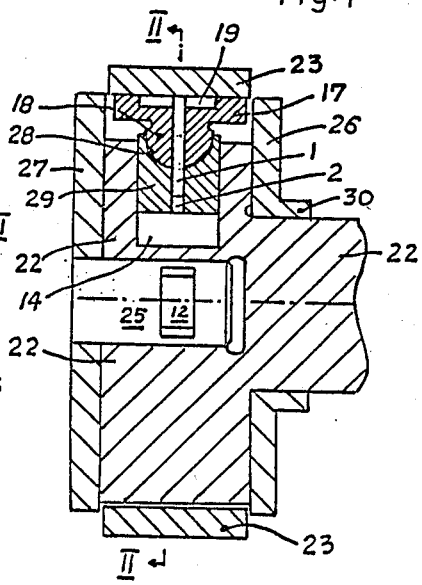
FIG. 1 is a longitudinal sectional view through one embodiment.
Figure 3:
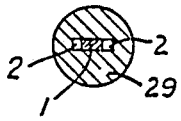
FIG. 3 is a sectional view through FIG. 2 along III—III.

In FIGS. 1 to 3 a body 22 contains a chamber 14, wherein a member 29 reciprocates or oscillates. Chamber 14 contains fluid under pressure. Another member 17 is associated to member 29 and borne on member 29 in a bed 28 by a pivot portion 18. The bed and pivot portion are of complementary part-ball-formed configuration. Part-ball configuration may also be called spherical and it may be the outside of the form of a ball or the inside of a part of a hollow ball.

Another body 23 guides the member 17 and thereby restricts the extent of the movement of the members in one direction. Members 18 and 29 are provided with recesses wherein an element 1 is located. The recesses and the element are of non-circular cross-section. The mentioned non-circularity prevents rotation of member 29 relative to member 17 and portion 18.

Body 22 is provided with retaining-walls 26, 27 which flank the ends of the sides of member 17, whereby they are forming retaining walls on opposite sides of one of the members.

One of the bodies must contain at least one retaining portion located on opposite ends of the members to limit the extent of the movement of the members. In FIGS. 1 to 2 the bottom of chamber 14 in body 22 forms one such retaining portion and the body 23 forms by its inner face the other retaining portion.

More details will appear from the enlargement Figures.

In FIGS. 1 and 2 is however a control body 25 demonstrated, which contains fluid passages and ports 11 and 12 to lead fluid through passage 13 into and out of chamber 13. That defines the arrangement of these Figures as a radial piston machine, the body 22 as a rotor, the body 23 as a piston stroke guide means or piston stroke actuator; member 29 as a piston, chamber 14 as a cylinder, member 18 as a piston-shoe, portion 18 as a pivot-portion of a piston shoe and bed and faces 28 as pivot bearing means between a piston and a shoe.

Piston 29 draws fluid into chamber 14 and expels it in a delivery stroke, when the piston moves radially inwardly. Rotor 22 may have a shaft 22 and be borne rotatably on control body 25 and bearing 30. The piston shoe 17 may be provided with a fluid pressure pocket 19 to form with the surrounding sealing land a hydrostatic bearing. Slots 20 may restrict the dimention of the hydrostatic bearing. Recess 2 in piston 29 may have a limited extension in one direction to limit a pivotion of holding element 1 in the extension(s) of slot 2.

Figure 6:
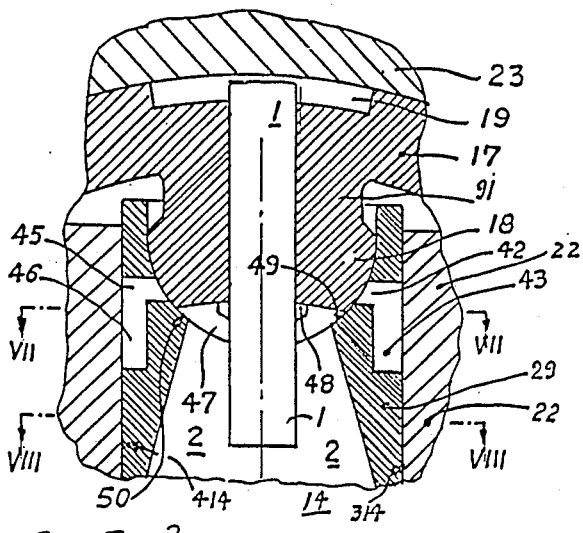
FIG. 6 is an enlargement of a portion of FIG. 1.
Figure 7:
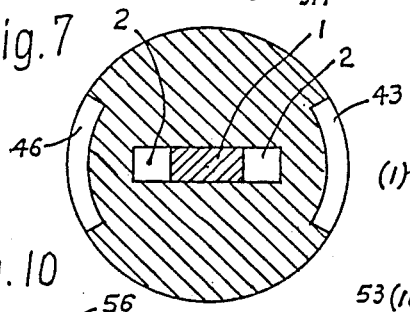
FIG. 7 is a sectional view through FIG. 6 along VII—VII.
Figure 8:
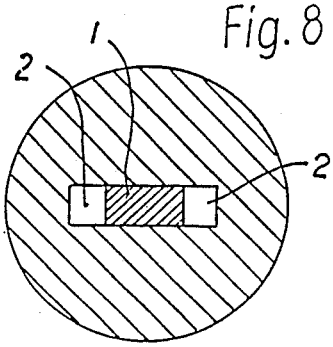
FIG. 8 is a sectional view through FIG. 6 along VIII—VIII.

FIGS. 6 to 8 show a portion of FIG. 2 in an enlarged scale. These Figures explain, that the member 17 has a slot 2 of non-cylindrical cross-section, whereinto or wherethrough the element 1 of a configuration fitting into slot 2 is provided. Member 29 reciprocates along a wall-face 314 or 414 of space 14. Member 29 has an outer face and slides with it along the respective wall-face, whereby it is provided, that one of the members does a movement in the mentioned space, whereby it slides with its outer face along a respective wall-face of the mentioned space.

Thereby is also provided, that two faces, namely the outer face of member 29 and the wall-face of space 14, slide along each other.

The body 23 of FIG. 2 has an axis which is eccentrically spaced from the axis of body 22. Thereby it is provided, that member 17 pivots on member 29, when one of the members rotates or varifies its position. This fact provides a pivoting load by member 17 onto member 29, when member 17 pivots out of the neutral position relative to member 29 when load is applied in chamber 14. The mentioned load produces a component of force or of load perpendicular or normal to the axis of piston member 29 in a direction normal onto the wall face 414 or 314.

The two faces slide along each other under a pivoting load.

Since member or piston 29 is reciprocating in cylinder or space 14 of body 22, it is also provided, that one of the bodies contains a space for the reception of at least one portion of one of the members.

Body or piston 29 has on its head a hollow face 49 of part-ball configuration, which forms a bearing bed 49 to bear thereon the pivot portion 18 of the other member or piston shoe 17 of the other member.

Piston shoe pivot-member 18 has an outer face 50 of a part of a ball, which is complementary to the face or bed 49 and able to be borne thereon and to swing or pivot thereon. Since further, as already described, a pivot-motion is forced onto member 17 by the bodies 22 and 23, it is provided, that both members 17 and 29 or portion 18 of member 17 and member or piston 29 pivot relative to each other in alternating opposite directions, when one of the members 17–18 or 29 is borne in the respective bed 49 or by the spherical bearing 49–50 between the members or of the other member 17–18 or 29.

When the described eccentricity is provided between the axes of bodies 22 and 23 and body or rotor 22 revolves around its axis, the members 17 and 29 are forced inwardly by body 23 into space 14 and outwardly by pressure in fluid in space 14. Thereby it is provided, that one of the bodies, namely body or piston 29 does a movement in space 14, namely an oscillating or reciprocating movement in space or cylinder 14, whereby member 29 slides with its outer face along the respective wall face 314,414 of the respective space 14.

The inner face of body 23 and the bottom of space 14 include on the bodies 22 and 23 retaining portions located on opposite ends of members 17 and 29 to limit the extent of the described movement, namely of the reciprocating movement of piston 29 with its outer face along the respective wall face 314,414 of the respective space, for example of cylinder 14.

Since body 22 of one of the bodies 22 and 23 is associated to walls 26 and 27, which may be integral with body 22 or 23 or be attached to body 22 or 23, it is provided, that the at least two bodies 22 and 23 include retaining portions 26, 27 located on opposite sides of member 17 of one of the members 17 and 29.

In FIGS. 6 and 7 it is clearly visible, that at least one pocket is provided in one of the members, and that the mentioned pocket is open toward the mentioned wall-face of the mentioned space. For example the FIGS. 6 and 7 show pockets 43 and 46 in piston or member 29 and they are open toward the respective wall-faces 314 or 414 of space or cylinder 14.

The same Figures show also, that one of the members is provided with a first passage means communicated with a chamber with fluid under pressure and a second passage means communicating with the mentioned pocket. For example recess 2 forms the first passage means and is communicated with chamber or space 14, which contains at least alternatingly fluid under pressure, as described herebefore. The second passage means has in the mentioned figures two passages 42 and 45 and they communicate with the mentioned pockets 43 or 46 respectively.

These Figures also show, that a third passage means 47 is provided in the other member 17–18 of the members for communication with the mentioned first passage means 2 and for alternating communication and dis-communication with the mentioned second passage means 42 or 45 during pivotion of the members 29 and 17–18 relative to each other.

In the Figures mentioned, piston shoe or member 17–18 pivots on piston or member 29. Thereby the third passage 47 or control-recess 47 moves alternately during a revolution of body or rotor 22 upwards in the left side of FIG. 6 to communicate with second passage means 45 and thereafter the left side of third passage 47 moves downward and the right side of recess or third passage means 47 moves upward for communication with the other passage 42 of the second passage means 42–45.

Figure 13:
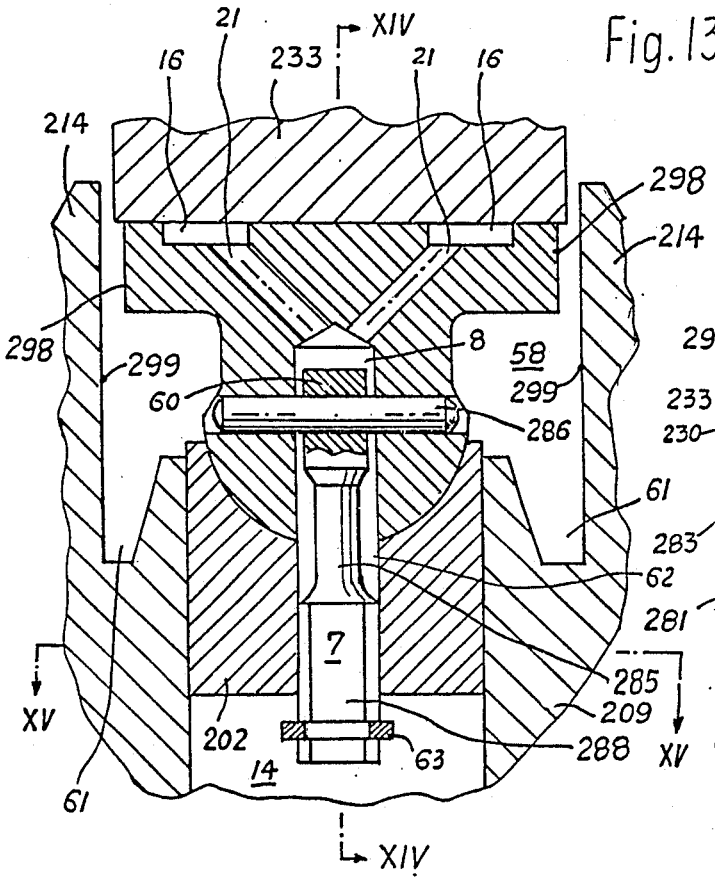
FIG. 13 a longitudinal sectional view therethrough.
Figure 14:
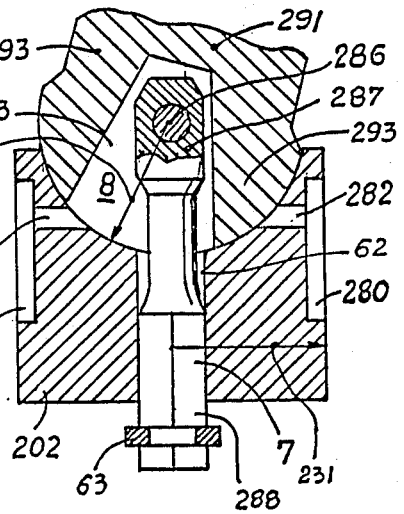
FIG. 14 a sectional view through FIG. 13 along XIV—XIV.
Figure 15:
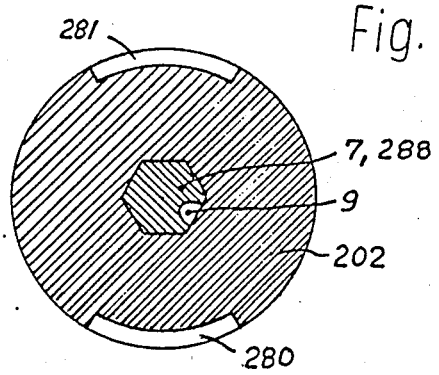
FIG. 15 a sectional view through FIG. 13 along XV—XV.

These Figures also show, that at least one of the members 17, 29 has an inner recess of non-circular cross-section. It can be seen for example, that the recess 2 is narrower in FIG. 1 than in FIG. 2. In member 29 as well as in member 17–18. This difference in size makes it clear, that the recess 2 is of a non-circular cross-sectional area or configuration. In FIGS. 1 to 3 and enlargements in FIGS. 6 to 8 it is substantially of rectangular configuration or cross-section. This is best seen in the enlargements shown in FIGS. 7 and 8, which clearly define the non-circular cross-section of recess 7. In FIGS. 13 to 15 the non-circular recess 62 is of a cross-section of a hexagon with equal sides and angles.

The Figures here discussed, also show, that the inner recess, for example 2, is open toward the other of the members. For example, the recess 2 in member 29 in FIGS. 6 is open towards the other member 17–18. The respective inner recess 2 may even extend through one or both of the members. That is the case in the now discussed figures. When member 29 is a longitudinal body, for example, a piston, moving in the direction of its longitudinal axis, and the other member 17–18 has a medial portion in the direction of the longitudinal member at pivot angle zero, the inner recess or recesses 2 or others may extend in the direction of the axis of the longitudinal member into or through one or both members. That is the case in many of the Figures, including in FIG. 6.

It is further illustrated in many of the Figures, that an element 1, 3, 5 or (109) or (288) in the parental application of non-circular cross-section which is at least partially complementary to the cross-section of the respective inner recess, is associated to both members, for example 29, 17–18; 202–293; 81–82; or 51, 75 or others and that the respective element extends into both of the members and into the respective inner recess 2, 62, 6, 4 or another respective inner recess.

In the diagrams 17 and 21 at hand of the respective Figures of this application, whereto the diagrams are explanatory, it is also proven that the mentioned passages supply fluid into the respective pocket to carry at least a portion of the load of the respective member on the respective wall-face. For example in FIG. 6 first passage 2 is provided by recess 2 and transfers fluid through the second passage 47 into the respective third passage 42 or 45 and therethrough into pocket 43 or 47, when the member 17–18 pivots into a respective position. The lateral or tangential load of member 29 is then at least partially, almost or totally carried by the force of fluid in pocket 43 or 46.

Since member 29 can pivot in one dimension only, the lateral or tangential load which it transfers over member 29 into the respective portion of the wall-face 414 or 314 has a specific direction. For example, that in the plane, where FIG. 2 is drawn and in its surrounding neighborhood. FIG. 6 demonstrates, that the pockets 43 or 46 are located in the mentioned plane and thereby in the direction of the load of the respective member. It is shown, that the pocket is located in the direction of the load of the respective member on said wall face.

Thus, when the member or piston 29 moves radially in and out in space 14, its movement is an oscillation with a stroke under load and another stroke under less load. For example, in a pump the inward stroke is a stroke under higher load and the outward stroke is a stroke under less load. In a motor the loading of the strokes is reversed.

The entire member 29 moves along the respective wall face 314,414 of space 14, but the portion of the member 29 which is pressed against a portion of a wall-face is that portion, wherewith the invention is concerned. The expression "movement" shall therefore concern that portion of the movement, which would be under a high load, when the invention would not be applied.

At such consideration, the movement of the respective member, for example piston 29, is provided in the concentration of the load of the respective member of said wall-face and in the direction of said load.

The so mentioned movement is a portion of the overall movement of the respective member, namely that portion of it, which concerns the invention.

With the above explanations, the aim of the invention is achieved, namely, that said recess and said element serve to maintain a first equal direction of said members relatively to each other, whereby they maintain said direction of said load and keep said movement in said concentration and direction of said load by preventing displacement of said pocket out of said concentration and direction of said load.

Figure 4:
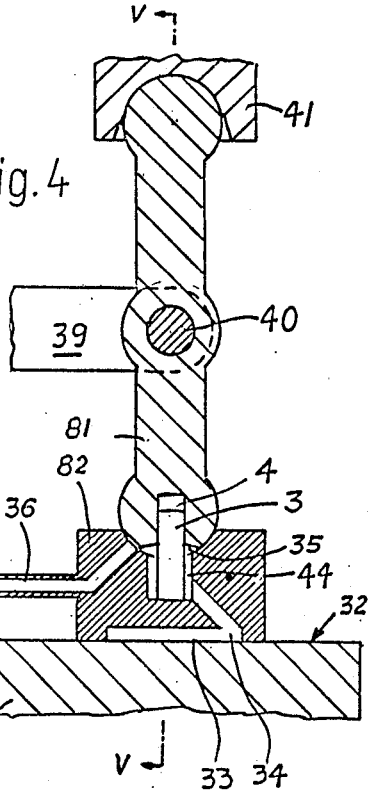
FIG. 4 is a longitudinal sectional view through another embodiment.
Figure 5:
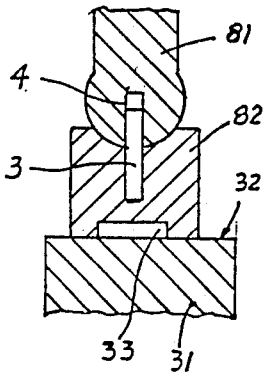
FIG. 5 is a sectional view through a portion of FIG. 4 along V—V.

In FIGS. 4 and 5 a mechanism is demonstrated, which may be used in machines, vehicles or stationary plants, where a movement takes place with a pair of strokes of basically opposite directions, when one of the strokes is under a higher and the other under a less high load.

Member 82 has a movement along the wall-face 32 of a body 31. Another body 39 or 41 drives said movement. A pivoting other member 81 is associated to the other body and pivots in member 82, when member 82 does its movement.

Since there is no specific guidance system for member 82, this member would run in any undesired direction along face 32, when the invention would not be applied.

According to the invention, the location and direction of the movement is supported by means of the invention, and there, where the load appears during movement of member 82 along wall-face 32, the movement becomes according to the invention, provided with the pocket of the invention, to carry at least a portion of the load.

One dimensional direction of one of the members, namely member 81, is maintained by holding means 40, 39. The alternating load acts downward in the figure and is supplied by body 41. Non-circular recess 3 is provided in member 81 and may be extended in the direction of the movement. A therein fitting, non-circular element 3 of a complementary configuration or cross-section is extended recess 4 and into recess 44 in member 82. Recess 44 is, as seen in FIG. 4, extended in the direction of the movement wider than the element 3 is. One of the recesses 4 or 44 may be of a size, just to hold member 3, but the other of the recesses 4 or 44 must be elongated in the direction of the movement to permit the pivotion of the respective portion of element 3 in it.

The materialize the aim of the invention in this embodiment of wide application in the different industries, vehicles, machines and the like, a source of fluid under pressure supplies pressurized fluid through passage 38 into chamber 37. Fluid line 36 may move in said chamber 37 with its open one end and be sealed relative to the outside from chamber 37. The other end of the fluid line 36 extends into member 82 and forms therein the first passage means of the invention. Control recess 35 forms the second passage means of the invention and passage 34 forms the third passage means of the invention and it ports into pocket 33 of the invention.

Thus, when member 82 does the rightward and leftward movement or strokes in FIG. 5, the second passage means 35 alternately communicates or discommunicates the third passage means with the first passage means and thereby leads alternately pressure in fluid into pocket 33, whereby the aim of the invention is materialized, that fluid pocket 33 carries a high load of member 82 at a stroke of high load, but does not supply such a high carrying power at the stroke under a less high load. Because at a lower load of member 82 the fluid pressure in pocket 33, might, if applied, lift the member 82 away from the wall-face 32.

Element 3 may in addition serve to guide the movement and the location of member 82 along wall face 32.

The expression:—non-circular cross-section—shall for example, define, that the cross-section has at least one corner or at least one straight line, which define a corner or a face on the respective recess or element. The complementarity of cross-sections of recess(es) and element(s) then prevent rotation relative to each other by the said corner or face.

Figure 11:
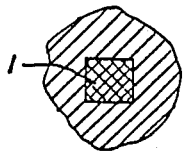
FIG. 11 is a sectional view through a portion of FIG. 9 along line XI—XI.
Figure 12:
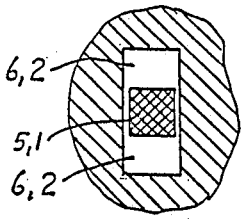
FIG. 12 is a sectional view through a portion of FIG. 9 along line XII—XII.
Figure 9:
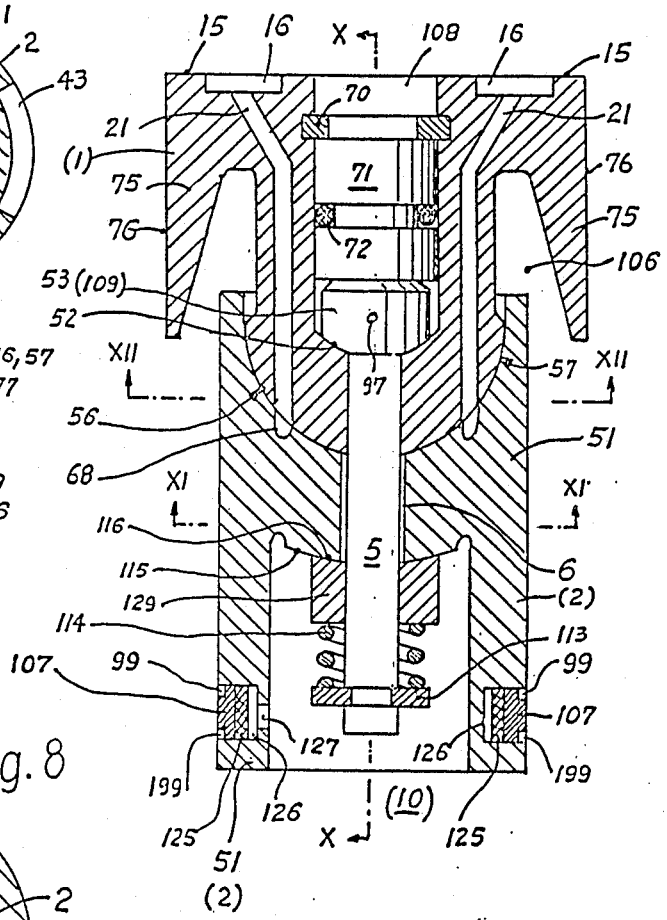
FIG. 9 is partially an enlargement of FIG. 28 of my mentioned grand parental application, now U.S. Pat. No. 4,037,523 and thereby a longitudinal sectional view through a portion of still another embodiment of the invention, wherein several means are added, which are not present in the mentioned U.S. Pat. No. 4,037,523.
Figure 10:
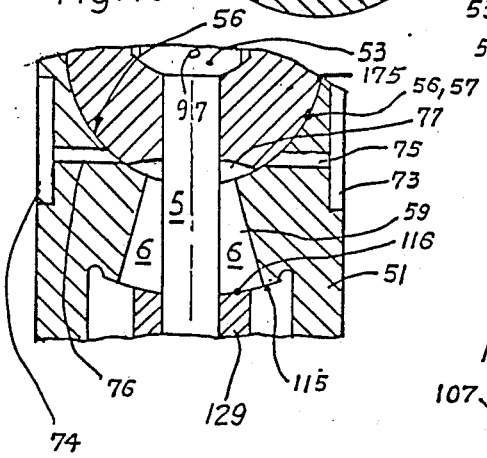
FIG. 10 is a sectional view through a portion of FIG. 9 along line X—X.
Figure 28:
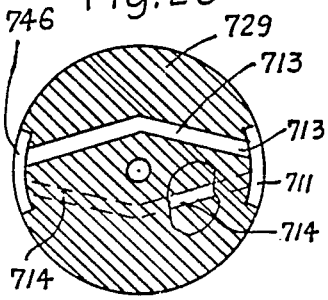
FIG. 28 is a sectional view through FIG. 24 along XXVIII—XXVIII, which demonstrates a provision which might be used or be eliminated, if so desired.

FIG. 9 with thereto belonging cross-sections in FIGS. 10, 11 and 12, is merely a repetition of FIG. 28 of my U.S. Pat. No. 4,037,523; however in an enlarged scale and with improvements by this invention to the present stand.

It provides a piston and piston-shoe assembly, which is pivotably connected together by seat (56, 57), holder (109), (129) and (113), which is freely floating radially in the respective cylinder (10). The referential numbers in parentheses indicate those of the grandparental patent.

The modifications by this present divisional are, that the holder 5 is not circular as in the grand-parental, but represents the element 5 of non-circular configuration, in this case of a cross-section of a square and that the recess 6 or 2 also has a non-circular cross-sectional configuration of the present divisional. In order to provide the pivotability in one of the recesses, at least one recess 6 or 2 is elongated in the direction of the pivotal swing. This is clearly seen in FIGS. 11 and 12, as well as in FIG. 10. Within member 75 the recess may be a square conforming to the square section of element 6, while the recess 6 in member 51 has the corresponding enlargements to a rectangle or to a rectangular taper in the direction of the longer side of the rectangle.

This makes it possible to provide the pockets 73 and 74 in the area of movement and direction of load and to port the second passages 75 and 76 into them. The third passage or recess 77 takes then over the alternating communication and discommunication at the pivotion of member 75 on member 51. The details of the figure are described in the mentioned grand parental patent and in the parental application. Ball-part formed face of pivot portion 175 is borne on the spherical bed face 56 and is able to slide and pivot thereon. End faces 76 of member 75 are kept between the respective retaining walls of one of the bodies and thereby prevented from rotation around the axis of element 5. The non-circularity of recess 6 and element 5 prevent rotation of member 51 relatively to member 75, whereby the pockets 73, 74 are at all times kept within the direction and concentration of the load directed from member 51 against the respective space-wall or space face. Passages 21 lead fluid from collection space 68 into radial balancing pockets 16. Pockets 16 are closed by one of the bodies. For example by the inner face of the piston stroke activator 33 of the parental patent.

Member or piston shoe pivot-portion 175 has a seat 52 for the reception and bearing of head 53 (109) of element 5. The said seat 52 is closed upwardly by the insertion of a closure means 71. Closure 71 may have or contain a seal means 72 to seal seat 52 upwards in the figure. Closure 71 may be kept by a holder 70, which may be a snap ring in member or piston shoe 75(1). The radially inwardly extending portions or extension 75 of the member or piston shoe (1) may be provided to enter them at a deep diving piston stroke into the grooves 61 of FIG. 13.

Element 5 extends from said seat 52 through recess 2, 6 in member 175 and through recess 6 in member or piston 51 while it remains able to swing in recess 6 in member 51 and it extends further downward beyond a portion and seat 115 of member 51. There it carries a holder-body 129 which has an inner face 116 of a configuration of a radius around the pivot center 97. Bearing face 115 has a complementary configuration of a substantially equal radius and carries said inner face of holder body 129. Fastener or snap ring 113 holds and spans a spring means 114 which presses the holder body 129 against face 115 and thereby forces the faces 56, 57 of the bed and face of the pivotal bearing of the member (1) or piston shoe (1), 75 on the bed and face 56 of member or piston 51 for close sliding engagement together and holds them together. The spanning force of means 114 is of a suitable strength to permit the pivotal movement of member (1) and to permit the slide of face 56 on face 57.

Member 51 has preferably close to its bottom, an annular groove 126 for the reception of a piston ring or seal means 107. Means 107 has at least one outcut 99 or also an additional outcut 199. A plastic seal means or O-ring 126 is inserted into the groove 126 below the ring or seal 107. A passage 127 leads fluid under pressure from space or cylinder chamber (10) into groove 126 and below plastic seal 125. Thereby the seal 125 is pressed against seal means 107 and seal 107 is deforming under said pressure radially outwardly against the respective wall-face to seal there against. The outcut(s) 99, (199) make sure, that the force from groove 126 is stronger than a force which might develop outwards of means 125. The cut-off 99 makes the outer face of means 107 shorter than the inner face thereof, whereby the higher force on the inner face of means 125 is assured and the desired deformation radially outwardly for sealing on the respective wall face 314,414 (for example) is secured in combination with the pressure supply through Passage 127.

FIGS. 13 to 15 are those of FIGS. 32 to 34 of the grand parental application. However in an enlarged scale and more clearly written.

The embodiment of the invention shown in FIGS. 13 to 15 is especially suitable for high pressure motors or for self-suctioning pumps or compressors.

A self suctioning pump prefers a piston and piston-shoe assembly, where piston and shoe are connected together, so, that they can not depart away from each other. Because the self-suctioning pump has no pre-pressure in the suction line. The piston can not be pressed radially outward by fluid. On contrary, it has to serve to draw in fluid.

When such self-suctioning pump shall operate under the highest pressure, however, the highest cross-sectional area of bearing portion between piston and piston shoe is desired. That prevents embracement of piston and shoe relative to each other, because embracement arrangements would take too much area on the outer portions of the pistons away from bearing purposes.

When the device acts as a motor or as a pump under very high pressure, the pivotion of the piston shoe provides a tangentially directed force-component on the piston, whereby piston 202 is pressed one-sidedly against the wall of the cylinder. This appearance is generally known from some of my earlier patents. But there were no means heretofore to prevent such appearance at pistons with part-spherical heads.

Due to the arrangement of FIGS. 32 to 34 of the mentioned application Ser. No. 05-765,221, which issued as U.S. Pat. No. 4,193,336 on Mar. 06, 1980, it is now however possible in accordance with this invention to provide and operate tangentially pressure balancing pockets 281 and 282 also in pistons with part spherical piston heads. Control-recess 233 in radially inward projecting portion 293 opens and closes passages 283 and 282 to pockets 281 and 280 during the pivotal movement of portion 293 similarly as in inventor's U.S. Pat. No. 3,225,706. Such action can be effective, however, only if the piston is prevented from rotation relative to the piston shoe. In order to achieve this, the holding pin 285 is provided in piston 202 and shoe portion 293. Holding pin 285 has a preferably ball-formed head 287 and extends therewith into a bore in piston shoe portion 293. It is pivotably fastened therein by cross-pin 286 whereby relative rotation between pin 285 and shoe portion 293 is prevented. The piston 202 is provided with a profiled recess 289 and pin end 288 is of complementary profile so that pin end 288 can axially move in profiled piston portion 289 but is prevented from rotation therein. In the Figures the profile is shown as of sixangular cross-section, especially demonstrated in FIG. 34. But the profile can be of any other suitable configuration which prevents rotation of the piston 202 around the pin 285. A retainer means 290 may be provided in order to retain springloaded or non-springloaded the piston 202 on pin 285. In such case, the piston and piston shoe are connected together by pin means 285 and the thereto associated means.

If no retainer means is set to retainer 290, the piston and shoe remain un-connected relative to each other. The free-floating of the piston shoe remains. Because the profiled portion 288 can freely move radially in the machine, which is axially in the piston 202. When piston shoe portion 293 moves radially away from the piston 202 and the said gap opens, the pin means 285 moves within said piston 202. Piston and shoe remain thereby radially free of each other, while prevention of relative rotation between piston and shoe remains prevented. Control of flow into tangential balance pockets 281 and 280 is immediately assured again, when the gap between piston and shoe is closed again. The correct direction and location of pockets 280 and 281 relative to the wall of the cylinder 210 is secured by the means of FIGS. 32 to 34 or by similar effective arrangements.

Equality or almost equality of radii 230 and 231 assures closely guided co-axial movement of the piston and shoe in cylinder 210. Innermost faces 299 on end elements are radially plane faces without any extensions inwardly beyond said plane faces. Thereby it is secured, that either the piston shoes alone, if they are unconnected to the pistons, or the piston and piston shoe assemblies, when pistons and shoes are connected to each other can move unhindered by end elements freely radially between said innermost faces 288 of end elements 214. To prevent axial dislocation of piston shoes the end faces 298 of the piston shoes may get respective close or non close fits relatively to the said innermost faces 299. Another means for prevention of dislocation of piston shoes is the equality or almost equality of radii 230 and 231 of the respective piston head and of the respective radially inwardly projecting portion of the respective piston shoe.

According to this present application, the pin 285 forms the element 7 and it is located in the non-circular recess(es) 8, 62. It is able to swing in recess 8. Rotor 209 constitutes one of the bodies which forms the retaining portions 214 to keep the endfaces 298 of member 291, 293 directed in one of the possible dimensions. The other member is 202 and it carries the first passage means 9, which may be a clearance of the element 7 in recess 62 or a passage 9 as shown in FIG. 15. The second passages are formed by references 282 and 283 in FIG. 14 and the third passage means is recess 8 or 233. Radii 230 define the spherical pivot bearing between members 202 and 293. Body 209 may have radially inwardly or otherwise suitably extending grooves 61 for the reception member extensions as for example extensions 75 of FIG. 9 to provide a large extent or stroke of the movement which is discussed in this application.

In the parental application the FIGS. 13 to 15 were also defined as excluding outer portions of the pistons or member 202 from holding the other member 291 on piston or member 202. Thus, the major intention of the Figures in the parental is, to make the radius 230 of the pivot bearing equal or almost equal to the radius of the piston or other member 202.

On contrary thereto, in accordance with this present application the radius 230 may be shorter than radius 231 in FIG. 14 in order to extend the outer portion of member 202 more upwards towards the pivot center 286 or even upwards beyond it in FIGS. 13, 14 in order to provide larger areas of the pocket of the invention in order to carry a higher load by the pocket(s) 280, 281.

That brings the disadvantage, that the radial bearing capacity of the pivot-bearing with radius 230 becomes smaller, but the carrying capacity of the pocket increases. The consequence thereof is, that the restriction in the parental is more useful for devices with smaller pivot-angles. But the Figures and definitions to FIGS. 13 to 15 of this application are more useful for bigger pivot-angle applications. The greater pivot angles bring greater load to the respective member and wall face. Since, however, a greater angle of pivotion brings in a given device of a given certain outer diameter a longer stroke of the movement and thereby a greater power, even when the pressure in the fluid becomes a little smaller.

This description would also be correct for FIGS. 13 to 15 of this application, when the last paragraph from "whereby the holding of said portion" to: "efficiency of the fluid machine" would be eliminated and when the FIGS. 13 to 15 would be exclusively used in a radial piston fluid machine.

As this specification has shown, the principle of the Figures, may however also be used in other systems than radial piston type fluid machines and the provision of grooves 61 and extensions 75 may even provide a higher power and efficiency, than that of the parental and it may do so without the provision of said last paragraph.

Figure 16:
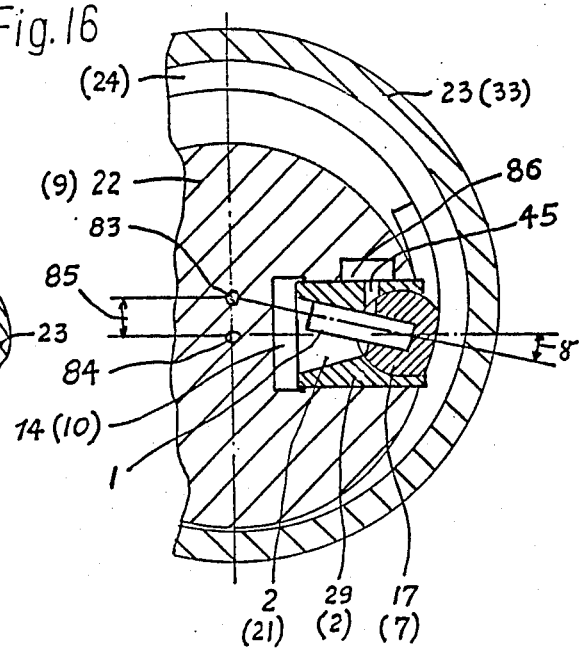
FIG. 16 is a cross sectional view through another embodiment of the invention.

FIG. 16 illustrates a possible modification of the invention. Namely, that the at least one pocket may be constituted by the second passage means 45 of the Figures, or by the outer port thereof. The speciality of FIG. 16 consists in such case therein, that at least one additional pocket, namely a wall-pocket, in and through the respective wall-face of the respective space or cylinder (10) 14, whereby said additional pocket 86 is provided in body 22 (9) ports into the outer port of second passage means 45 and thereby communicates with it. Pocket 86 is then filled alternately with fluid under pressure and takes over the function of at least one pocket of the invention, which is, to carry at least a portion of the load exerted by one of the members, for example by member 29 or (2) in FIG. 16.

Figure 17:
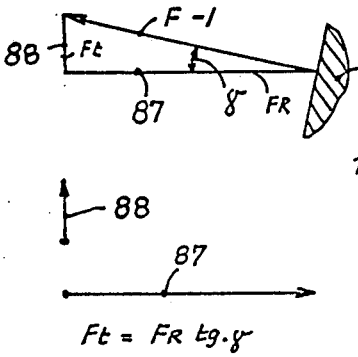
FIG. 17 is a diagram.

FIG. 17 demonstrates, that the force out of space 14 is reflected from body 23 by an angle gamma and appears then as force "F-1". The angle gamma defines the relation of the tangential forces component "Ft" in relation to the radial component of force "Fr" by the equation "*Ft*"="*Fr*" multiplied by tangent"γ".

Figure 21:
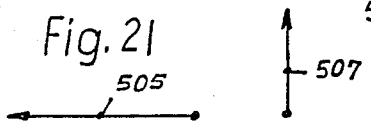
FIG. 21 demonstrates a schematic explanation.

Thus, a small angle gamma gives a smaller load of member 29 on wall 314, 414, but a greater angle "gamma" gives a greater load. FIG. 21 will later show, that at an angle "gamma" larger than 45 degress, the force may even be increased over the original force out of space 14.

Figure 18:
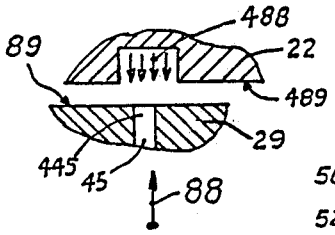
FIG. 18 is an enlargement of a portion of FIG. 16.

FIG. 18 shows the decisive portion of FIG. 16 in an enlarged scale and illustrates, that the lateral or tangential force "Ft" of FIGS. 16 and 17, represented by referential 88 is carried by a contrary directed force 488 which acts in pocket 86. That reduces the load on wall face 489 and acts against the outer face 89 of member 29 to secure a smooth stroke or movement of face 89 along face 489.

Figure 20:
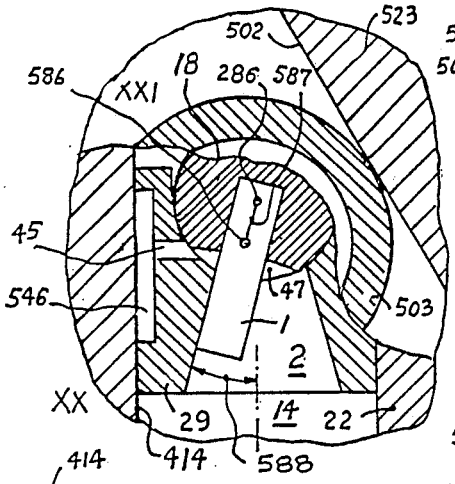
FIG. 20 is a sectional view through FIG. 19 along XX—XX.
Figure 19:
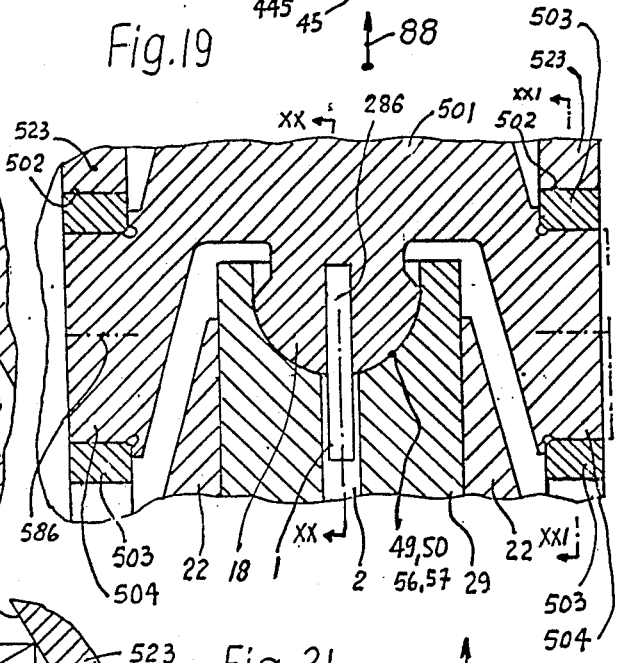
FIG. 19 is a longitudinal sectional view through a still further embodiment of the invention.
Figure 19:
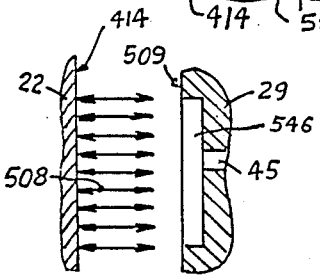
Figure 19:
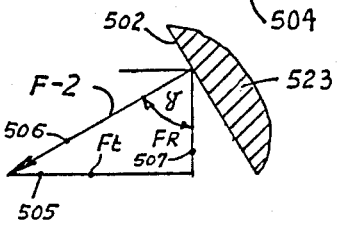

In FIGS. 19 and 20 the member 22 carries in space 14 a member 29 which is associated to a pivotable member 501. The members include the known recess 2, element 1, first passage 2, second passage 45 and the third passage 47 as well as the spherical pivot portion with bed and faces 49, 50 or 56, 57 of the earlier described Figures. The pivot-portion 18 is also provided.

By a reason, which will be seen soon, the pocket 546 forms however a much larger pocket, than the pocket 45 of the earlier Figures.

Body 523 forms a pair of very stiff guide faces 502 for the guidance of the member 501. In the Figure the angle of attack=gamma is written to be, for example, 60 degrees. See also FIG. 21.

Member 501 carries on a pair of bearings 504 the rollers 503, which roll along the guide face 502 of the stationary body 523.

FIG. 20 has an upper portion showing a portion of FIG. 19 in section XXI—XXI and a bottom portion showing the section XX—XX of FIG. 19 in part. The double section is provided to illustrate in a single FIG. 20 the action of guide face 502 in relation to rollers 503 and at same Figure the action of pocket 546.

The spherical pivot-bed or bearing 49, 50 is preferred here to adjust probable machining mistakes of faces 502 by a second slight pivotability of portion 18 around center 286. The second pivotion, when it appears at all, is then done in a plane substantial normal to the medial plane of the first pivotion, the general pivotion of the invention.

The force exerted from space 14 onto member 29 is equal to the area of the bottom of member 29 multiplied with the pressure in space 14. When the member 29 is a piston of diameter "d", the bottom area will be $(d)^2pi/4$ or $d \times d \times 0.7854$.

Assuming a piston of 2 cm diameter as in small pumps or motors, we obtain, for example, 800 atmospheres pressure in space 14:

Radial force="Fr"=2 cm×2 cm=4 ×0.7854=3,14 $cm^2 \times 800$ atm.

which gives=2512 Kg radial force "Fr".

Radial force Fr=507 (FIG. 21) must be transformed by the equation in FIG. 17 into a tangential component of force, namely 505 which acts as the load of member 29 on wall-face 502. For gamma=60 degrees as in the Figure, the equation gives:

$Ft_2 = Fr + g\gamma$ for 60°γ and $Fr$2512 Kg=$Ft_2$=2512×1.732=4350 Kg.

Comparing for equal "Fr" the angle gamma about 10 degrees of FIG. 17, the "Ft" would be:

$Ft_1$=2512 Kg×0.1763=≈443 Kg.

The above simple calculation of two extremities shows, for example,:

(a) That the stiff inclination of the angle of the guide face of the piston stroke guide, which becomes possible by this embodiment of the invention, not only transfers the whole of the radial force into torque, but it can even transform the radial force into a "x-times" higher force in the direction of the torque and thereby produce a very high torque; and;

(b) That a so produced torque can even be roughly ten times higher than the torque of an already deep diving piston and shoe with about ten degrees inclination of the piston stroke guide face. In radial piston devices with outer piston shoes, as in the common art, the inclination is even less than ten degrees and the resulting torque even smaller.

On the other hand, such steep increase in torque results naturally in a slower rotary velocity, because otherwise the acceleration forces in the device would become too high.

FIG. 21 shows, that the angle "gamma" is here about 60 degrees, which gives a tangent gamma of 1.732. That means, as the Figure shows, that the tangential force "Ft" in the direction of the torque becomes 1.732 times of the radial force "Fr". The tangential force 505, which produces the torque of the motor, is now 1.732 times stronger, than the radial force 507. The Figure also shows, that the fluid in the pocket 546 creates a fluid pressure field 508, which acts against the torque-force 505 in opposite direction and thereby balances the force of torque 505 which is transfered from guide face 502 over the rollers 503 onto the piston-shoe 501, and via the pivot-portion 18 onto the piston or member 29. Thereby any major or all friction between the wall 509 of member or piston 29 and wall 414 of space 14 is prevented.

Since, however, the fluid pressure field 508 acts also in the opposite direction, the fact appears, that the force of torque 505, transferred from the above described parts onto the wall 414 of space 14 and thereby onto the revolvable rotor 22, is not any more transfered by mechanical, friction causing force, but by the force of fluid under pressure with almost none or only a remaining minimum amount of friction between the walls or faces 509 and 414.

Since roller 503 is borne on face 502 of body 523, and neither the body 523 nor the face 502 can move backward or in any other way away from where they are, because they are stationary, the rearwardly directed force of fluid out of pocket 546, which acts against the piston 29, acts over piston 29 against the non-moveable face and body 502, 523 which can not move away from where they are, the consequence thereof is, that the forwardly directed force of fluid out of pocket 546, which is directed against the wall 414 of the respective cylinder of the rotor 22, produces a torque on wall 414 of rotor 22 and this torque is revolving the rotor 22, because the wall 414 is the single means in the arrangement which can under the forces of fluid in pocket 546 move away, because it is the wall of the single moveable means, namely of the rotor 22, which is revolvingly borne in the device.

The rollers 503 in FIGS. 19, 20 roll on portions 504 of piston shoe 501 around axes 586, which are extended by length 587 from pivot center 286. Element 1 limits the pivotion to angle 588 just enough to secure the communication between recesses or passages 2 and 45 over recess or passage 47. When however, the pockets 546 would be in the body 22, as described in my U.S. Pat. No. 4,624,174; and the control of the alternation of flow of fluid into respective pockets in body 22 would be applied, then the pivotion is not necessary and the pivotion to angle 588 as well as the distance 587 can then be spared.

Figure 23:
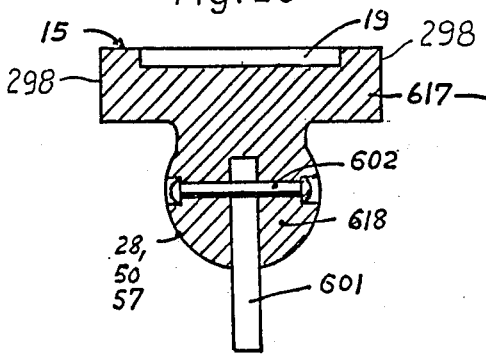
FIG. 23 is a sectional view through FIG. 22 along XXIII—XXIII.
Figure 22:
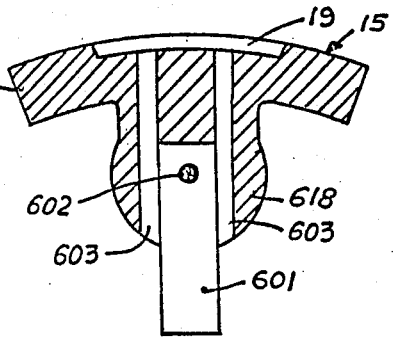
FIG. 22 is a cross-sectional view through another member of the invention.

In FIGS. 6 and 22 to 23 it is shown, that it is suitable to prevent, that the element 1 can move against the inner wall of the body 23 or to the guide face thereof. Because if it could do so, it might scratch and cause friction there. In FIG. 6 that is accomplished by the stoppers 48. In FIGS. 22 and 23 it is made by inserting a retainer, like a pin 602, which might be nutted or riveted. It extends through portion 618 and through element 1, thereby holding element 1 in pivot-portion 618. In such application the problem arises, that there might be no space left for setting the passage 3 to the radial pocket 19. FIG. 22 therefore illustrates, that two passages 603 may be set laterally of the element 601 to bring the desired result. If they would be set through the sectional plane of FIG. 23, passages 603 would surround retainer 602, whereby it might become necessary to seal retainer 602 axially toward the outside.

In FIGS. 22 to 28 those portions, which have equal referential numbers as in other Figures illustrate equal portions as in other Figures.

FIGS. 24 to 28 illustrate an embodiment of the invention, wherein the member 729 is not prevented from rotation relative to the other member 717. Piston shoe 717 is guided by the end walls of one of the bodies, but, since the pivot bed 28, 749 and the pivot-portion 718 are spherical, the piston 729 is not prevented from rotation relative to piston-shoe 717.

As this specification teaches at hand of the other Figures, such an arrangement is not an ideal solution. However, sometimes it might be done. And, when it becomes done and applied, then other methods of leading fluid into the required pocket are needed. Those other methods are illustrated in these Figures.

The member 729 gets a plurality of pockets 743, 746, "a" to "l" with thereto communicating second passages 742, 745. The mentioned pocket "a" to "l" are located under angular spacing around the periphery of piston or member 729. Since piston shoe or member 717 is prevented from rotation, because it is guided between the retaining walls on one of the bodies, the third passage or recess 47 remains directed in one single dimension. This direction is toward the portion of the wall face of the respective space or cylinder, wherein the movement under tangential load of the invention occurs. When now piston or member 729 revolves around its longitudinal axis in passage 702, fluid pockets **746-745-*b* and 742-743-*a* revolve away from the mentioned area of movement. But then another pair of passages and pockets "b" to "l" moves into communication with third passage or recess 47** and takes then over the fluid under pressure to provide the pressure forces in the area of movement or at least in the close neighborhood of the area of movement under load of the invention.

Figure 24:
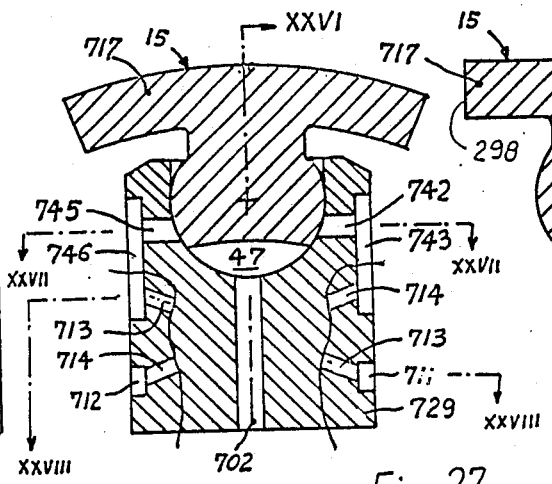
FIG. 24 is a cross-sectional view through two members of another embodiment of the invention.
Figure 26:
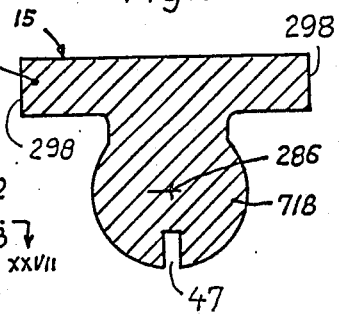
FIG. 26 is a sectional view through FIG. 24 along XXVI—XXVI.
Figure 25:
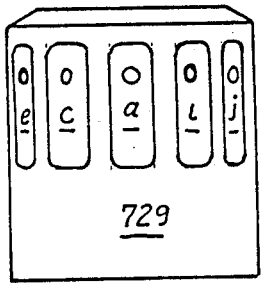
FIG. 25 is a view onto a member of FIG. 24 along XXV—XXV.

When the piston or member 729 is short and its upper end remains below the outer portion of the other member or piston shoe 717, a tilting force might appear on the member or piston 729 close to the bottom thereof and be directed in opposition to that of the main pockets 745, 746 *a* to *l*. A counter-directed pocket pair set 711–712 may then be applied as seen in FIGS. 24 and 28. Respective passages 713 or 714 will then communicate the respective higher located main pocket 746 with the respective counter pocket 711 or pocket 743 with counter pocket 712. A number of such counter pockets 711, 712 may be provided and be supplied by passages, which like passage 713, 714 inclined through member or piston 729 at different heights and different angular spacing along lines XXVIII—XXVIII of FIG. 24 and in the gist of FIG. 28.

As far as bodies in this specification have been called rotors and others actuator means or piston stroke actuator guides, it should be understood, that the functions might become reversed, when the housing or outer body of the arrangement revolves and the inner body is stationary. That may for example be the case, when the inner body is fastened in a vehicle to drive the outer body in a rotary movement, for example, to carry and drive the wheels of a vehicle, or respective other revolvable members.

In FIG. 16 the eccentricity 85 is shown between the axes 83 and 84 of bodies 23 and 22.

Figure 29:
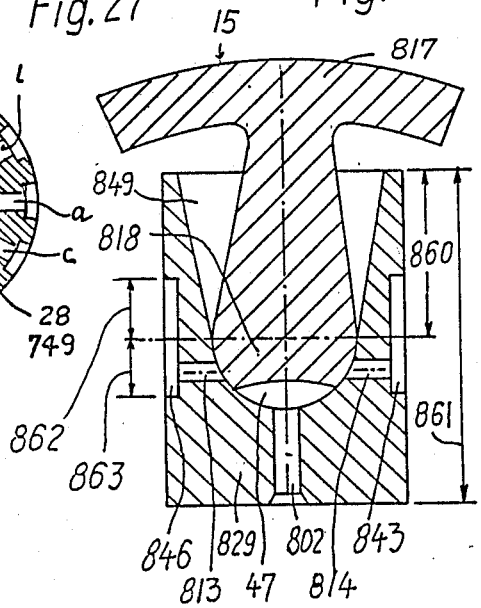
FIG. 29 is a longitudinal sectional view through the last embodiment of the invention.

In FIG. 29 the gist of the invention is still further perfected. The second member is pivotably borne in the bearing bed of the first member, basically as in FIG. 24. The second member 817 may be a piston shoe and the first member 829 may be a piston. The gist of this FIG. is that in FIG. 24 the piston shoe exerts a lateral force onto the piston and tends to tilt the piston even as the pockets 746 etc. are applied.

Figure 27:
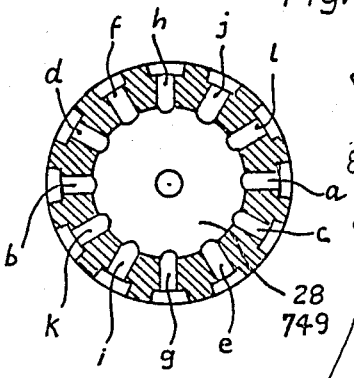
FIG. 27 is a sectional view through FIG. 24 along XXVII—XXVII.

The tendency to still tilt the piston in the cylinders comes from the fact that the center of the pivotal movement is not in the middle of the axial length of the piston. FIG. 29 realizes this matter and prevents any tendency, however small, to tilt an end of the piston in the cylinder. The center of the bearing bed of piston 829 is, therefore, provided in the axis of the piston and in the middle of the axial length of the piston. The length of the piston is shown by 861 and the half thereof, which defines the middle, is shown by referential 860. Thereby the center of the pivot bar 818, which is the foot of the piston shoe, is defined to lay in the longitudinal axis of the piston and at the middle distance 860 of length 861 of the piston 829. The pockets 843, 848, or pockets a, b, c, d etc., are provided in piston 829 in angular spacing as in FIGS. 25 and 27. Insofar FIG. 27 is also a cross sectional view through the middle of FIG. 29. The pockets 843, 846 etc., are, however, in axial direction relative to the piston, provided around the axial middle 860 by equal oppositional directed distances 862 and 863. Thereby the pockets are axially seen in the middle of the length of the piston. Passages 802, 813 and 814 are provided similar as passages 742 and 745 etc. of FIG. 24 in FIG. 29. The gist which underlies this embodiment of the invention is that the lateral force of the foot of the piston shoe is exerted from the center of the pivot portion 818 onto the bearing bed of the piston and thereby onto the piston. To bear this lateral force on the wall of the piston, the pockets 843, 846 etc. should be provided exactly in the equal axial height of the piston as the center of pivot portion 818 is provided. Thus, the pockets have to extend in this embodiment in equal distances 862 and 863 in opposite directions axially along the wall of the piston 829. Thereby the perfect action of the pockets is secured and any tilting forces, however small they might be, are effectively prevented by the arrangement of FIG. 29. The respective communication of the respective pocket (pockets) to the fluid pressure supply is effected by control recess 47 in FIG. 29 similarly as in FIGS. 24 to 27. Thereby an error of the former art, that the pockets might be provided more close to one end of the piston than to the other end of the piston, which error resulted in a remaining tendency to tilt the piston, is now perfectly overcome by the gist and the arrangement of FIG. 29 of this present invention.

As is illustrated in FIG. 13, the second body or piston shoe may be provided with lateral end faces 298 which can be guided along respective parallel end wall members 214 of the rotor 209 in which the respective first member or piston reciprocates. Such end faces 298 may also be provided on the piston shoes of FIGS. 23, 26, 29 or others and such piston shoe end faces 298 may then be guided on respective rotor end wall members 214 if the respective piston shoes are inserted into a respective rotor which has such end members 214.

The control recesses 47 are then extended in the direction parallel to the pivotal movement of the piston shoes and parallel to the end faces 298 of the piston shoes and thereby parallel to the end members 214 of the respective rotor wherein the respective piston reciprocates. Those pockets of the piston which are then communicated to the respective fluid pressure supply passage, are then located in the direction of the pivotal movement while all other pockets which are not at the respective time in the direction of the pivotal movement are then not communicated to the fluid pressure supply passage and, consequently, are then not loaded with fluid under pressure from the fluid supply passage through the respective piston. Since in radial piston machines, such as illustrated partially in FIG. 13, and in which the mentioned piston shoes of other Figures of this application may be applied, for example, FIG. 29 may be applied, the rotor (for example, 209) revolves around an axis and is borne in bearings on the ends of such axis of the rotor, the direction of the pivotal movement is then exactly normal to the axis of the rotor. Any fluid pressure pocket of a piston which is then by control recess 47 communicated to the fluid supply passage through the piston then acts in one of the directions of the pivotal movements against the rotor and thereby tangentially and normal to the normal of the axis of the rotor. Any forces by the fluid in the pockets in the pistons in directions against the bearings which bear the rotor, are, thus, prevented by the present invention, also by its FIG. 29, and the disadvantage of axial piston devices, where pockets in the pistons act in every time changing directions relative to the bearings of the rotor, are overcome by the present invention. Note also that the control recess 47 should be narrower than the complementary face portions between three adjacent passages "a" to "l" of passages 813 or 814 to secure that recess 47 meets only one, or unaxiually two passages 814 or 813-"*a*" to "*l*".

As far as it is stated in this specification or the claims thereof, that a torque is produced on a rotor by a fluid pressure pocket, the matter may be best understood at a study of FIG. 20. Body 523 is stationary, whereby face 502 can not move away from where it is. But the rotor 22 is revolvably mounted in the device. Since the piston 29 presses the members 503 outwards for moving leftwards, when rolling along the face 502, the component of pressure in pocket 546 which presses against the wall of the piston 29 can not press the piston rightwards away, because the piston is supported over body 503 on the non-moveable face 502. Since however, the rotor 22 is able to revolve, the force of fluid in pocket 546, which presses against the wall 414 of the cylinder 14 of the rotor 22 forces the wall 414 to move leftward in FIG. 20. Thereby the force of fluid in pocket 546 actually provides a torque onto the wall 414 and thereby onto the rotor 22, under which the rotor 22 revolves. The rotor 22 may transfer this torque out of the device for example by providing a motoring action.

The importance of the present invention may also be understood at hand of a discussion of the prior art patents for revolvable pistons. In this respect the German publication No. 1 403 754 discloses three fluid pressure pockets equally spaced around the periphery of the piston in an axial piston machine. Due to the length of the piston, these pockets serve merely for the lubrication of the movement of the piston in the respective cylinder. The pressure supply is not directed to a specifically located pocket of the pockets.

The German publication No. 2 031 091 provides cross-lubrication on the opposite portion of the periphery of a piston or it deals with fluid pressure pockets on a piston which is prevented from rotation by a piston pin.

U.S. Pat. No. 1,866,057 has no control of fluid flow to pockets in the periphery of the piston.

The Thoma U.S. Pat. No. 3,106,138 which is older than the first mentioned German publication, provides also three pockets angularly equally spaced around a piston of an axial piston machine and the pockets again serve mainly for the lubrication, while the fluid supply is not directed into a specific pocket of the pockets.

My own U.S. Pat. No. 3,223,046 and my British Pat. No. 1,439,352 provide balancing pockets on pistons which are prevented from rotation around their axes. So specifically does my U.S. Pat. No. 3,225,706.

The Aldinger U.S. Pat. No. 3,828,653 does not deal with tangential balancing or pressure pockets on pistons.

The Breisch-U.S. Pat. No. 4,170,167 does also not provide pockets on revolvable pistons to carry a lateral load of the pistons.

The herebefore most perfect carrying of lateral load of the pistons in radial piston pumps and motors is shown in my U.S. Pat. No. 3,225,706. However, even in this Patent the carrying of the lateral load of the piston is not perfect. This patent erred partially because it failed to provide the fluid pressure pockets in the middle of the axial length of the piston and thereby it failed to place the pockets in the axial hight of the perfect center of pivotal movement of the piston shoe. Further, it deals with fluid pressure pockets on pistons which are prevented from rotation around their longitudinal axes. In this Patent the piston has a part cylindrical bed wherein a part cylindrical portion of the piston shoe pivots and the mentioned part cylindricality prevents rotation of the piston relative to the piston shoe while the piston shoe is prevented from rotation by its guide in the device.

While my mentioned Patent could provide perfect solution for carrying the lateral load on pistons which are prevented from rotation around their longitudinal axes, it fails to do so by placing the center of pivotion and the balancing pockets into the middle of the axial length of the piston. It fails further fully, to provide or suggest means to introduce or to perfect the carrying of lateral load of the piston if the piston is not prevented from rotation around its longitudinal axis.

The pistons which are prevented from rotation around their longitudinal axes require the provision of an expensive part cylindrical bed in the piston and a respectively complementary part cylindrical portion on a piston shoe which is even more expensive in production and which both require an absolute accuracy of the direction of the axes of the bed and portion relative to the longitudinal axis of the respective piston.

The present invention overcomes this problem by the provision of the lateral load carrying pockets on the revolvable piston, which can now have the simply producable and lappable spherical beds and piston shoe portions.

To obtain the object of the invention, the delicate solution of the present invention must be provided. Especially there must be at least twelve pockets equally spaced provided around the periphery of the piston, and the mentioned pockets must be placed equally axially extended around the middle of the axial length of the piston while the center of the pivotal movement of the piston shoe must be in the middle of the axial length of the piston. If there would be less than twelve pockets equally spaced around the periphery of the piston, then the area of fluid pressure on the periphery of the piston would become too large if instead of a single one, two of the pockets would become communicated to the pressure flow control recess 47 of FIG. 29. Note in this respect that, since the piston is revolvable around its axis, because it is not prevented from such revolving, it can never be guaranteed that the control recess 47 meets only a single flow passage 813 or 814. Thus, the device must work, either, with a single pocket "a" to "l" or with two of them communicated to the respective passage 813 or 814. Thus, if there would be less than twelve pockets, the fluid pressure out of two of the pockets would become too high and would cause the piston to be forced onto the opposite wall portion of the respective cylinder wherein the piston reciprocates. As more pockets are placed equally angularly spaced around the periphery of the piston, as more perfectly the present invention will work. It must be at least twelve such pockets because otherwise the effects can become disastrous.

More details of the preferred embodiments appear from the appended claims and the claims are therefore considered to be a portion of the description of the preferred embodiments of the invention.

What is claimed, is:

1. An arrangement of two members with a first member having an axially directed medial axis and a spherical bearing bed provided symmetrically around a portion of said medial axis to bear pivotably on said bearing bed a pivot portion of the second member of said two members, a control recess provided in said pivot portion of said second member to communicate with a fluid supply passage through a portion of said first member, wherein at least twelve angularly equally spaced individual fluid containing pockets are provided in the outer face of said first member and said pockets are provided with control fluid passages which extend individually from said pockets through respective portions of said first member into said bearing bed, whereby said control recess in said pivot portion communicates alternatingly with a respective control passage of said control passages and thereby communicates at the respective time said fluid supply passage to said respective control passage and thereby to said respective pocket when said second member pivots in said first member, wherein said bearing bed is formed around the middle of the axial length of said first member and said pockets are extended from the said axial middle of said first member in opposite axial directions equally from said middle of said first member, wherein said arrangement is provided in a device which includes guide means to guide said second member for prevention of rotation and of rotation of the direction of the pivotal movement of said second member whereby said second member is forced to maintain a direction of said control recess parallel to the direction of the pivotal movement of said second member in order to communicate exclusively with a respective pocket of said pockets which is at the respective time located in the direction of said pivotal movement of said second member.

2. An arrangement to reduce friction in a device which includes at least two bodies, two members and two faces which slide along each other under a pivoting load;

wherein one of said bodies contains a space for the reception of at least a portion of one of said members, wherein one of said members is provided with a hollow spherical bed to bear therein a pivot portion of the other of said members, wherein said members pivot relative to each other in alternating opposite directions when one of said members is borne in said bed of the other of said members, wherein one of said members does a movement in said space by which it slides with its outer face along a respective wall face of a wall which borders said space, wherein said bodies include retaining portions located on opposite ends of said members to limit the extend of said movement, wherein at least one of said bodies forms retaining walls on two opposite sides of one of said members, wherein at least one pocket is provided in one of said members respective to the axis of one of said members at least partially radially of the center of said pivot portion and said pocket is open towards said wall face, wherein one of said members is provided with a first passage means communicated to a chamber with fluid under pressure and a second passage means communicated with said pocket, wherein a control recess is provided in the other of said members for communication with said first passage means and alternating communication and discommunication with said second passage means during the pivotal movement of said one of said members, wherein said recess is open towards the other of said members, wherein said passages supply in periodic cycles fluid into said pockets, serve to maintain at said cycles fluid and pressure in said pocket and to carry at least a portion of the load of said member on said wall face, wherein said pocket is located in the direction of the load of the respective member on said wall face, wherein said movement is an oscilation with a stroke under load and another stroke under less load, wherein said movement is occurring in the concentration of the load of the respective member on said wall face and in the direction of said load, wherein said recess controls a transfer of fluid pressure into said pocket, wherein said retaining walls provide a keeping force on one of said members to keep it aligned in at least one direction by which it makes this member to a non rotary member, wherein said recess is provided in said non rotary member, wherein said members are free of devices to prevent rotation of one of said members relative to the other of said members by which one of said members becomes a revolvable member, wherein said at least one pocket consists of a plurality of at least twelve individual pockets which are angularly equally spaced around the periphery of said revolvable member and each individual pocket has an individual passage of said second passage means wherein said recess of said non-rotary member is so narrow in one of its dimensions that it communicates during said communication only with one single passage of said individual passage(s) of said second passage means with said one individual pocket of said at least twelve pockets which is located substantially in the said concentration of said load, by which it forms a selection of communication to passages and pockets, and, wherein said recess, said transfer, said keeping force and said selection are utilized to maintain said pocket in said direction of said load and on said movement in said concentration and direction of said load by preventing the passing of fluid to pockets which are out of said direction of said load and by passing of fluid into at least one of said pockets which is at the respective time present in said concentration and direction of said load.

3. A piston and piston shoe arrangement for a radial piston machine wherein fluid flows through substantially radially directed cylinders, comprising, in combination, pistons for reciprocation in said cylinders and piston shoes to be borne by said pistons and to be guided by a piston stroke guide ring while said piston shoes have outer and inner portions with said inner portions forming pivot portions with pivot faces of equal radii around pivot centers and with said outer portions forming slide faces to slide along a guide face of said piston stroke ring whereby said guide face holds said slide faces and said piston shoes parallel to a medial plane which is normal to the axis of the rotor which has said cylinders, while said pistons have in their outer ends hollow spherical pivot beds with bed faces of said radii and complementary configuration relative to said pivot faces to pivotably bear thereon said pivot portions of said piston shoes;

wherein said pistons are freely revolvable relative to said piston shoes due to the part spherical configurations of said beds and pivot portions;

wherein bores through said pistons communicate said beds with said cylinders;

wherein said pistons have outer faces to be guided on the inner faces of said cylinders and to seal said cylinders by close fits of said outer faces on said inner faces, while at least twelve peripheral angularly spaced pockets are provided through said outer faces into said pistons respective to the axes of said pistons at least partially radially of said pivot centers, wherein passages extend from said pockets through portions of said pistons towards said bed and through said bed face, and;

wherein control recesses are provided in said pivot portions with said recesses extended parallel to said medial plane while they are narrow parallel to said axis of said rotor to communicate and discommunicate alternately during each revolution of said rotor and completion of a pivotal movement of said piston shoe on said piston said recesses with those of said passages which meet said recesses during said pivotal movement;

whereby fluid under pressure is passed from said cylinders through said bores, recesses and passages into those of said pockets which are close to said plane to exert forces onto said pistons which oppose forces which are exerted onto said pistons by said piston shoes during said pivotal movements of said shoes.

4. An arrangement to reduce friction in a device which includes at least two bodies, two members, a piston stroke guide face and two pairs of faces which slide along each other under a load;

wherein one of said members is a piston in a substantially radially arranged cylinder in the first body of said bodies with said piston forming on its radial outer portion a bearing bed of the configuration of a portion of a hollow ball extending from said outer portion radially inwardly into said piston while said bearing bed forms a bearing face with a first radius around the center of said bearing bed, wherein the other of said members is a piston stroke transfer member which is located between said piston and the other of said bodies with said piston stroke transfer body forming a pivot portion which extends radially inwardly from the medial portion of said transfer body to form a swing face of a second radius around a swing center of said pivot portion with said second radius substantially equal to said first radius, wherein said pivot portion is inserted into said bearing bed by which said centers coincide and said bearing face and said swing face, which form together said first pair of faces of said pairs of faces meet each other with said swing face sliding along said bearing face when said pivot portion of said transfer member pivots in said bearing bed of said piston, wherein one of said bodies is stationary and the other of said bodies is revolvable relative to the other of said bodies and the second body of said bodies forms at least one stroke guide face of said stroke guide face to guide thereon a portion of said transfer member with said stroke guide face forming angularly respective to the axis of said first body increasing and decreasing distances from said axis of said first body to the respective portions of said stroke guide face to guide the strokes of said transfer member and of said piston when one of said bodies revolves, by which said stroke guide face also controls the periodic pivotal movement of said transfer member and the periodic pivotal movement of said pivot portion in said bearing bed when one of said bodies revolves, wherein the wall of said cylinder forms a cylindrical face and said piston forms an outer face to form together the second pair of faces of said pairs of faces with said second pair of faces having substantially equal third and fourth radii around coinciding axes of said cylinder and of said piston, wherein passage means extend through said piston to port into a control recess which is provided in said pivot portion, and, wherein at least twelve fluid pressure receiving pockets are provided through said outer face into said piston with said pockets communicated by control passages to said bearing bed and through said bearing bed face to port into said bearing face, at least one of said control passages at a location over which said control recess moves periodically at said pivotal movement to periodically open and close said passage when one of said bodies revolves, while said pockets are angularly spaced around the periphery of said piston along said outer face of said piston said pockets located relative to said axis of said piston at least partially radially of said swing center of said pivot portion while said control recess is configured with a control portion which meets the respective control passage which leads to that pocket of said pockets which at the respective time is located in the direction of the lateral load which is exerted onto said piston by the respective angle of pivotal movement of said pivot portion and of said transfer body at the respective time of communication of the said control recess with the respective passage and pocket of said control passages and pockets.

5. An arrangement, to reduce friction in a device which includes at least two bodies, two members and at least two faces wherein said faces slide along each other under a pivoting load;

wherein one of said bodies contains a space for the reception of at least a portion of one of said members;

wherein one of said members is provided with a bed to bear thereon a pivot portion of the other of said members;

wherein said members pivot relative to each other in alternating opposite directions when one of said members is borne in said bed of the said other of said members;

wherein one of said members does a movement in said space whereby it slides with its outer face along a respective wall face of a wall which borders said space, wherein said bodies include retaining portions located on opposite ends of said members to limit the extent of said movement, wherein at least one of said bodies forms retaining-walls on two opposite sides of one of said members;

wherein at least one pocket is provided in one of said members and open toward said wall face;

wherein one of said members is provided with a first passage means communicated to a chamber with fluid under pressure and a second passage means communicated with said pocket;

wherein a third passage means is provided in the other of said members for communication with said first passage means and alternating communication and discommunication with said second passage means during the pivotal movement of said members;

wherein said recess is open toward the other of said members;

wherein said passages supply fluid into said pocket; serve to maintain fluid and pressure in said pocket and to carry at least a portion of the load of said member on said wall face;

wherein said pocket is located in the direction of the load of the respective member on said wall face;

wherein said movement is an oscillation with a stroke under load and another stroke under less load;

wherein said movement is provided in the concentration of the load of the respective member on said wall face and in the direction of said load;

wherein said recess forms said third passage means to provide a transfer of fluid pressure into said pocket;

wherein said retaining walls provide a keeping force for one of said members to keep it aligned in at least one direction, thereby making said member to a non rotary member;

wherein said recess is provided in said non-rotary member;

wherein said members are free of devices to prevent rotation of one of said members relative to the other of said members, whereby one of said members becomes a rotatable member;

wherein said at least one pocket consists of a plurality of at least twelve individual pockets angularly spaced around the periphery of said rotatable member and each individual pocket has an individual passage of said second passage means;

wherein said recess in said non rotary member is so narrow in one of its dimensions, that it communicates during said communication only with those individual passage(s) of said second passage means and that individual pocket(s) of that at least one pocket, which are located substantially in the said concentration of said load; whereby it forms a selection of communication to passages and pockets; and;

wherein said recess, said transfer, said keeping and said selection are utilized to maintain said pocket in said direction of said load and on said movement in said concentration and direction of said load by preventing the passing of fluid to pockets, which are out of said load and by passing of fluid into at least one of said pockets which is present at the respective time in said concentration and direction of said load.

* * * * *